US009762992B2

(12) United States Patent
Akino

(10) Patent No.: US 9,762,992 B2
(45) Date of Patent: Sep. 12, 2017

(54) CONDENSER MICROPHONE UNIT, CONDENSER MICROPHONE, AND METHOD OF MANUFACTURING CONDENSER MICROPHONE UNIT

(71) Applicant: Hiroshi Akino, Kanagawa (JP)

(72) Inventor: Hiroshi Akino, Kanagawa (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/149,248

(22) Filed: May 9, 2016

(65) Prior Publication Data

US 2016/0330544 A1 Nov. 10, 2016

(30) Foreign Application Priority Data

May 8, 2015 (JP) ..... 2015-095479
Mar. 24, 2016 (JP) ..... 2016-059414

(51) Int. Cl.

*H04R 1/28* (2006.01)
*H04R 19/04* (2006.01)
*H04R 29/00* (2006.01)
*H04R 31/00* (2006.01)

(52) U.S. Cl.

CPC ..... *H04R 1/2896* (2013.01); *H04R 19/04* (2013.01); *H04R 29/005* (2013.01); *H04R 31/006* (2013.01); *H04R 2203/12* (2013.01)

(58) Field of Classification Search

CPC ..... H04R 1/2896; H04R 19/04; H04R 3/00
USPC ..... 73/862.046, 718; 181/158; 345/156, 345/157; 381/66, 174, 337, 355, 356, 381/358, 111, 175, 190, 384, 386, 396; 257/415; 367/132; 438/53; 700/258
See application file for complete search history.

(56) References Cited

U.S. PATENT DOCUMENTS 4,789,044 A * 12/1988 Akino ..... H04R 1/38 181/158
5,825,718 A * 10/1998 Ueki ..... H04B 13/02 367/132
5,889,872 A * 3/1999 Sooriakumar ..... H04R 19/016 381/174
6,061,457 A * 5/2000 Stockhamer ..... H04R 1/00 367/140

(Continued)

FOREIGN PATENT DOCUMENTS

JP 200-050386 A 2/2000

*Primary Examiner* — Gerald Gauthier
(74) *Attorney, Agent, or Firm* — Whitham, Curtis & Cook, P.C.

(57) ABSTRACT

A condenser microphone unit is provided that can flatten a frequency response in a high frequency band. The condenser microphone unit includes a unit case having an acoustic-wave entering hole, and a diaphragm accommodated in the unit case. The diaphragm is configured to vibrate in response to acoustic waves from the acoustic-wave entering hole. In the condenser microphone unit, an acoustic resistor is disposed between the acoustic-wave entering hole and the diaphragm. The acoustic resistor includes two elastic members in pressure contact with each other. At least one of the two elastic members is curved in a convex shape before contacting the other of the two elastic members by the pressure contact. A convex surface of one of the two elastic members is a surface that comes in pressure contact with the other elastic member.

10 Claims, 8 Drawing Sheets

(56) References Cited

U.S. PATENT DOCUMENTS 6,870,937 B1 * 3/2005 Hirosaki ..... H04R 19/005 381/174
7,152,481 B2 * 12/2006 Wang ..... B81B 3/0072 381/176
7,346,178 B2 * 3/2008 Zhe ..... H04R 31/003 381/174
7,349,551 B2 * 3/2008 Skillicorn ..... H04B 1/385 381/376
7,706,554 B2 * 4/2010 Ogura ..... H04R 19/016 257/416
7,804,969 B2 * 9/2010 Wang ..... B81B 3/0051 381/174
7,853,027 B2 * 12/2010 Yamaoka ..... B81C 1/00944 381/174
7,881,489 B2 * 2/2011 Matsuzawa ..... B06B 1/0292 381/171
8,129,803 B2 * 3/2012 Martin ..... B81C 1/00182 257/415
8,309,386 B2 * 11/2012 Weigold ..... B81C 1/00944 257/E21.002
8,325,951 B2 * 12/2012 Wang ..... H04R 19/005 381/175
8,538,057 B2 * 9/2013 Ikeda ..... H04R 1/083 381/150
9,020,179 B2 * 4/2015 Akino ..... H04R 1/326 381/356
9,113,238 B2 * 8/2015 Akino ..... H04R 3/00
9,516,427 B2 * 12/2016 Akino ..... H04R 19/04
2003/0146900 A1 * 8/2003 Endo ..... G06F 3/0338 345/156
2004/0181312 A1 * 9/2004 Miura ..... B25J 13/085 700/258
2005/0002538 A1 * 1/2005 Yonehara ..... H04R 19/016 381/174
2006/0109990 A1 * 5/2006 Akino ..... H04R 19/04 381/174
2010/0077868 A1 * 4/2010 Joung ..... G01L 5/228 73/862.046
2011/0012829 A1 * 1/2011 Yao ..... G06F 3/045 345/157
2011/0280418 A1 * 11/2011 Matsunaga ..... H04R 19/016 381/174
2012/0207315 A1 * 8/2012 Kimura ..... G10L 21/034 381/66
2013/0039526 A1 * 2/2013 Inoue ..... G10K 9/13 381/386
2013/0148836 A1 * 6/2013 Akino ..... H04R 19/04 381/355
2014/0270276 A1 * 9/2014 Iwakura ..... H02K 35/06 381/190
2016/0118914 A1 * 4/2016 Ifuku ..... H01L 41/257 310/317
2016/0330544 A1 * 11/2016 Akino ..... H04R 1/2896

* cited by examiner

CONDENSER MICROPHONE UNIT, CONDENSER MICROPHONE, AND METHOD OF MANUFACTURING CONDENSER MICROPHONE UNIT

TECHNICAL FIELD

The present invention relates to a condenser microphone unit, a condenser microphone, and a method of manufacturing the condenser microphone unit.

BACKGROUND ART

An example control scheme for an omnidirectional condenser microphone is an elastic control scheme. In this scheme, the resonance frequency of the mechanical vibration system of a non-directional condenser microphone is set to be a high frequency close to the upper limit of the sound collection band. As a result, a frequency response of the omnidirectional condenser microphone in a frequency band lower than or equal to the resonance frequency becomes flat.

When a resonance frequency of the condenser microphone is set outside the audible range, a frequency response in the entire sound collection band becomes flat and the sensitivity of the condenser microphone decreases. On the other hand, when a resonance frequency of the condenser microphone is set near the middle of the sound collection band, the sensitivity of the condenser microphone increases and the frequency response decreases with a slope of −12 dB/Oct in a frequency band higher than or equal to the resonance frequency. Thus, by setting the resonance frequency close to the upper limit (approximately 10 kHz) of the sound collection band and then adjusting the resonance sharpness, the resonance response in the sound collection band of the condenser microphone is flattened.

FIG. 5 is a cross-sectional side view illustrating a conventional omnidirectional condenser microphone.

A condenser microphone unit (hereinafter referred to as "conventional unit") 2*a* includes a unit case 2*c* and an electroacoustic transducer 20. The electroacoustic transducer 20 converts acoustic waves from a sound source to electrical signals and outputs the electrical signals. The electroacoustic transducer 20 is accommodated in the unit case 2*c*. The conventional unit 2*a* is attached to a circuit case (not shown).

The unit case 2*c* is composed of metal. The unit case 2*c* has a shape of a hollow cylinder with a closed end. A bottom face of the unit case 2*c* is disposed at the front (the direction of the microphone that is directed to the sound source during sound collection, the same applies hereinafter) side of the unit case 2*c*. The unit case 2*c* includes an acoustic-wave entering hole 2*h*, an open end 2*e*, a flange 2*f*, and an internal thread 2*s*. The acoustic-wave entering hole 2*h* introduces acoustic waves from a sound source into the unit case 2*c*. The acoustic-wave entering hole 2*h* is disposed in the bottom face of the unit case 2*c*. The open end 2*e* is the rear end of the unit case 2*c*. The flange 2*f* is composed of the bottom face of the unit case 2*c* having the acoustic-wave entering hole 2*h*. The internal thread 2*s* corresponds to an external thread provided on the circuit case (not shown). The internal thread 2*s* is disposed at the rear side of the inner circumferential surface of the unit case 2*c*.

The electroacoustic transducer 20 includes a diaphragm holder (diaphragm ring) 21, a diaphragm 22, a spacer 23, a fixed electrode 24, an insulator 25, a support 26, an insulating base 27, an electrode extraction terminal 28, and a contact pin 29.

The diaphragm holder 21 supports the diaphragm 22. The diaphragm holder 21 is ring-shaped. The diaphragm holder 21 has a hole in its center. The diaphragm 22 has a shape of a disc. The diaphragm 22 has a metal (preferably gold) film deposited on one side. The diaphragm 22 is a thin film composed of synthetic resin. The diaphragm 22 is stretched on the diaphragm holder 21 with predetermined tension. The spacer 23 is composed of synthetic resin, for example. The spacer 23 has a shape of a thin ring. The fixed electrode 24 is composed of metal. The fixed electrode 24 has a shape of a disc. At least one of the faces of the fixed electrode 24, for example, the face adjacent to the diaphragm 22, has an electret plate bonded thereto. The fixed electrode 24 and the electret plate constitute an electret board. The diaphragm 22 is disposed adjacent to the fixed electrode 24 with the spacer 23. A layer of air (gap) having a thickness equivalent to that of the spacer 23 is positioned between the diaphragm 22 and the fixed electrode 24. The diaphragm 22 and the fixed electrode 24 constitute a capacitor. The capacitance of the capacitor varies with the vibration of the diaphragm 22 in response to acoustic waves from a sound source, passing through the acoustic-wave entering hole 2*h*.

The insulator 25 supports the fixed electrode 24 and electrically insulates the fixed electrode 24 from the unit case 2*c* and the diaphragm 22. The insulator 25 has multiple communication holes. The penetrating direction of the communication holes is the thickness direction (the horizontal direction in FIG. 5) of the insulator 25.

The support 26 is attached to the rear face of the insulator 25 in an airtight manner. Air chambers are defined between the fixed electrode 24 and the insulator 25 and between the insulator 25 and the support 26 via the communication holes of the insulator 25.

The insulating base 27 is disposed behind the support 26. The insulating base 27 has a connection hole. The penetrating direction of the connection hole is the thickness direction (the horizontal direction in FIG. 5) of the insulating base 27.

The electrode extraction terminal 28 extracts signals from the fixed electrode 24. The electrode extraction terminal 28 is attached to the central area of the insulator 25. The rear end portion of the electrode extraction terminal 28 is inserted into the front half of the connection hole of the insulating base 27. The contact pin 29 is electrically connected to the electrode extraction terminal 28 via an elastic material (not shown) such as a conductive sponge. The contact pin 29 is inserted into the rear half of the connection hole of the insulating base 27.

The electroacoustic transducer 20 is fixed inside the unit case 2*c* with a lock ring 20*r* that fits the internal thread 2*s*.

A field effect transistor (FET) and a circuit, for example, are included in the circuit case. The FET constitutes an impedance converter of the electroacoustic transducer 20. The circuit is, for example, a circuit which converts a variation in the capacitance between the diaphragm 22 and the fixed electrode 24 to electrical signals and outputs the electrical signals.

FIG. 6 illustrates an equivalent circuit of a conventional omnidirectional condenser microphone.

In FIG. 6, symbol p represents the sound pressure of acoustic waves from a sound source; symbol m0 represents the mass of the diaphragm 22; symbol s0 represents the stiffness of the diaphragm 22; symbol r0 represents the damping resistance of the diaphragm 22 due to the layer of air between the diaphragm 22 and the fixed electrode 24; symbol rf represents the acoustic resistance in front of the diaphragm 22 (at the front open end among the front and rear open ends of the hole of the ring diaphragm holder 21, the front open end facing the rear open end which the diaphragm 22 is stretched on); symbol sf represents the stiffness of the air chamber (the internal space in the hole in the ring diaphragm holder 21) at the front of the diaphragm 22; and symbol s1 represents the stiffness of the air chamber at the rear of the diaphragm 22.

The damping resistance r0 of the diaphragm 22 reduces the resonance sharpness to a certain degree. However, by the shape effect, the frequency response in a frequency band higher than or equal to the resonance frequency increases. Thus, the adjustment of the frequency response by adding an acoustic resistor to the front of the diaphragm 22 is required. Schemes have been proposed to make acoustic resistance of an acoustic resistor disposed at the front of a diaphragm variable to adjust the frequency response (for example, refer to Japanese Unexamined Patent Application Publication No. 2000-50386).

SUMMARY OF INVENTION

Technical Problem

When an acoustic resistor having an area similar to that of the vibrating portion of the diaphragm 22 is added to the front of the diaphragm 22, the frequency response is affected by internal loss due to the vibration of the acoustic resistor.

FIG. 7 is a graph illustrating the frequency response of a condenser microphone without an acoustic resistor at the front of the diaphragm.

FIG. 7 indicates an increase in the frequency response in a frequency band higher than or equal to the resonance frequency.

FIG. 8 is a graph illustrating the frequency response of a condenser microphone including an acoustic resistor composed of nonwoven fabric at the front of the diaphragm.

FIG. 8 indicates an increase in the frequency response in the approximate range of 2 to 3 kHz due to vibration of the acoustic resistor and a decrease in the frequency response at approximately 15 kHz due to internal loss of the material.

An object of the present invention, which has been made to solve the problems described above, is to provide a condenser microphone unit that can flatten a frequency response in a high frequency band.

Solution to Problem

The present invention provides a condenser microphone unit that includes a unit case having an acoustic-wave entering hole; a diaphragm accommodated in the unit case, wherein the diaphragm is configured to vibrate in response to acoustic waves from the acoustic-wave entering hole; and an acoustic resistor disposed between the acoustic-wave entering hole and the diaphragm. The acoustic resistor includes two elastic members in pressure contact with each other. At least one of the two elastic members is curved in a convex shape before contacting the other of the two elastic members by the pressure contact, and a convex surface of the at least one of the two elastic members curved in a convex shape is in the pressure contact with the other of the two elastic members.

According to the present invention, frequency response in a high frequency band can be flattened.

DESCRIPTION OF EMBODIMENTS

Embodiments of a condenser microphone unit, a condenser microphone, and a method of manufacturing a condenser microphone unit according to the present invention will now be described with reference to the attached drawings.

<Condenser Microphone Unit>

Figure 1:
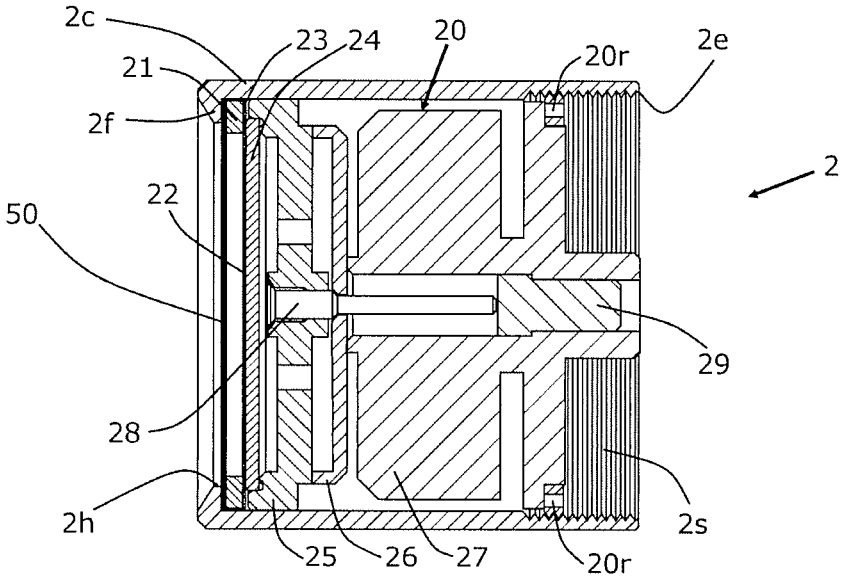
FIG. 1 is a cross-sectional side view illustrating a condenser microphone unit according to the present invention.

FIG. 1 is a cross-sectional side view illustrating an embodiment of a condenser microphone unit according to the present invention (hereinafter referred to as "unit").

Figure 2:
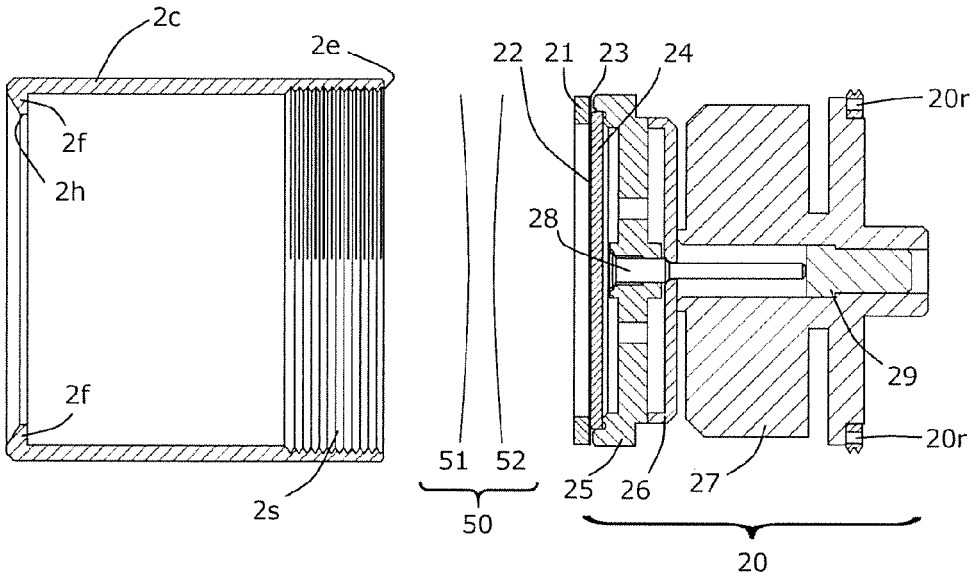
FIG. 2 is an exploded cross-sectional side view of the condenser microphone unit in FIG. 1.

FIG. 2 is an exploded cross-sectional side view illustrating the unit.

A unit 2 includes a unit case 2*c*, an electroacoustic transducer 20, and an acoustic resistor 50. The electroacoustic transducer 20 converts acoustic waves from a sound source to electrical signals and outputs the electrical signals. The electroacoustic transducer 20 is accommodated in the unit case 2*c*. The operation of the acoustic resistor 50 will be described below.

Figure 5:
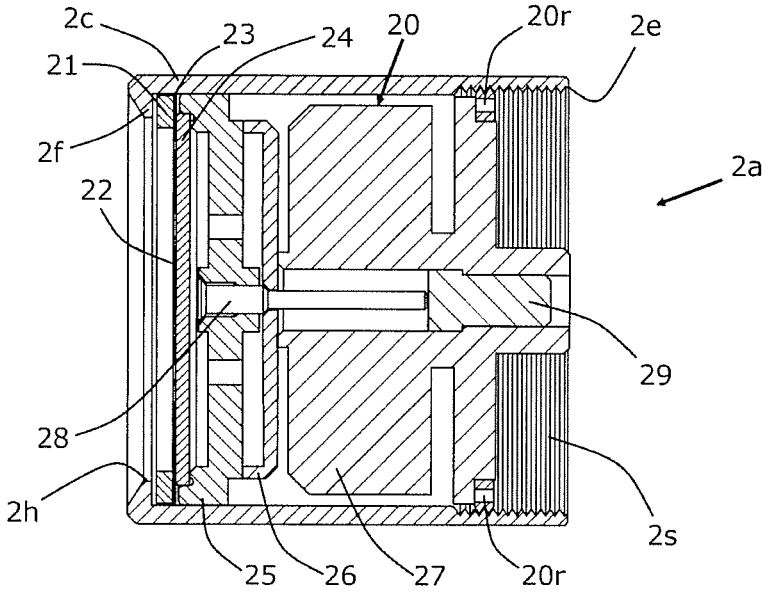
RELATED ART FIG. 5
FIG. 5 is a cross-sectional side view of a conventional condenser microphone unit.
Figure 6:
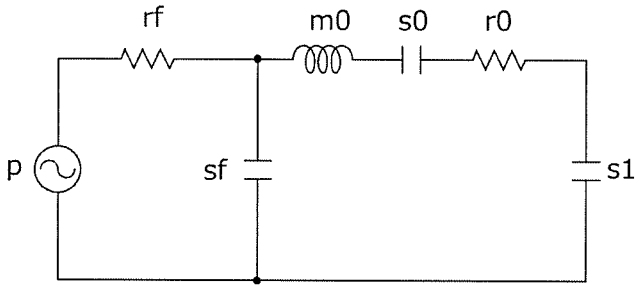
RELATED ART FIG. 6
FIG. 6 illustrates an equivalent circuit of the conventional condenser microphone.

The unit 2 is different from the conventional unit 2*a* illustrated in FIG. 5 in that the acoustic resistor 50 is added to the conventional unit 2*a*.

The unit case 2*c* is composed of metal. The unit case 2*c* has a shape of hollow cylinder with a closed end. A bottom face of the unit case 2*c* is disposed at the front (the direction of the microphone that is directed to the sound source during sound collection, the same applies hereinafter) side of the unit case 2*c*. The unit case 2*c* includes an acoustic-wave entering hole 2*h*, an open end 2*e*, a flange 2*f*, and an internal thread 2*s*. The acoustic-wave entering hole 2*h* introduces acoustic waves from a sound source into the unit case 2*c*. The acoustic-wave entering hole 2*h* is disposed in the bottom face of the unit case 2*c*. The open end 2*e* is the rear end of the unit case 2*c*. The flange 2*f* is composed of the bottom face of the unit case 2*c* having the acoustic-wave entering hole 2*h*. The internal thread 2*s* is disposed at the rear side of the inner circumferential surface of the unit case 2*c*.

The electroacoustic transducer 20 includes a diaphragm holder (diaphragm ring) 21, a diaphragm 22, a spacer 23, a fixed electrode 24, an insulator 25, a support 26, an insulating base 27, an electrode extraction terminal 28, and a contact pin 29.

The diaphragm holder 21 supports the diaphragm 22. The diaphragm holder 21 is ring-shaped.

The diaphragm 22 has a shape of a disc. The diaphragm 22 has a metal (preferably gold) film deposited on one side. The diaphragm 22 is a thin film composed of synthetic resin. The diaphragm 22 is stretched on the diaphragm holder 21 with predetermined tension.

The spacer 23 is composed of synthetic resin, for example. The spacer 23 has a shape of a thin ring.

The fixed electrode 24 is composed of metal. The fixed electrode 24 has a shape of a disc. At least one of the faces of the fixed electrode 24, for example, the face adjacent to the diaphragm 22, has an electret plate bonded thereto. The fixed electrode 24 and the electret plate constitute an electret board.

The diaphragm 22 is disposed adjacent to the fixed electrode 24 with the spacer 23 disposed therebetween. A layer of air (gap) having a thickness equivalent to that of the spacer 23 is positioned between the diaphragm 22 and the fixed electrode 24. The diaphragm 22 and the fixed electrode 24 constitute a capacitor. The capacitance of the capacitor varies with the vibration of the diaphragm 22 in response to acoustic waves from a sound source, passing through the acoustic-wave entering hole 2*h*.

The insulator 25 supports the fixed electrode 24 and electrically insulates the fixed electrode 24 from the unit case 2*c* and the diaphragm 22. The insulator 25 has multiple communication holes. The penetrating direction of the communication holes is the thickness direction (the horizontal direction in FIG. 1) of the insulator 25.

The support 26 is attached to the rear face of the insulator 25 in an airtight manner. Air chambers are defined between the fixed electrode 24 and the insulator 25 and between the insulator 25 and the support 26 and are connected via the communication holes of the insulator 25.

The insulating base 27 is disposed behind the support 26. The insulating base 27 has a connection hole. The penetrating direction of the connection hole is the thickness direction (the horizontal direction in FIG. 1) of the insulating base 27.

The electrode extraction terminal 28 extracts signals from the fixed electrode 24. The electrode extraction terminal 28 is attached to the central area of the insulator 25. The rear end portion of the electrode extraction terminal 28 is inserted into the front half of the connection hole of the insulating base 27. The contact pin 29 is electrically connected to the electrode extraction terminal 28 via an elastic material (not shown) such as a conductive sponge. The contact pin 29 is inserted into the rear half of the connection hole of the insulating base 27.

The electroacoustic transducer 20 is fixed inside the unit case 2*c* with a lock ring 20*r* that fits the internal thread 2*s*.

The acoustic resistor 50 has a shape of a disc. The acoustic resistor 50 includes elastic members 51 and 52. The elastic members 51 and 52 are in the form of plates. The elastic members 51 and 52 each have a shape of a disc. The elastic members 51 and 52 are prepared through electrocasting, for example. The elastic members 51 and 52 are composed of nickel, for example. The elastic members 51 and 52 each have multiple openings. The penetrating direction of the openings is the thickness direction (the horizontal direction in FIG. 2) of the elastic members 51 and 52. The elastic members 51 and 52 are in pressure contact with each other.

Before the pressure contact, the central portions in plan view (the central portions in the vertical direction in FIG. 2) of the each elastic members 51 and 52 are curved in convex shapes. That is, the elastic member 51 is curved rearward (toward the right in FIG. 2). The elastic member 52 is curved forward (toward the left in FIG. 2).

In each of the elastic members 51 and 52, the convex surface curved in a convex shape is the surface in pressure contact with the other elastic member. That is, the convex surface (the right face in FIG. 2) of the elastic member 51 is the surface in pressure contact with the elastic member 52. The convex surface (the left face in FIG. 2) of the elastic member 52 is the surface in pressure contact with the elastic member 51. The elastic members 51 and 52 constitute the acoustic resistor 50 having a shape of a disc, as the convex surfaces of the elastic members 51 and 52 come into pressure contact with each other.

At least one of the two elastic members constituting the acoustic resistor 50 should be curved in a convex shape before contacting the other of the two elastic members by the pressure contact. In this case, the other elastic member has a shape of a flat plate without curves.

The convex surface of the curved elastic member is the surface in pressure contact with the other elastic member.

<Method of Manufacturing Condenser Microphone Unit>

A method of manufacturing the unit 2 will now be described.

The elastic members 51 and 52 are accommodated in the unit case 2*c*. The elastic members 51 and 52 are disposed with their convex surfaces facing each other. The elastic member 51 of the elastic members 51 and 52 accommodated in the unit case 2*c* is in contact with the flange 2*f*. As a result, the elastic member 51 is positioned inside the unit case 2*c*.

Next, the electroacoustic transducer 20 including the diaphragm 22 is accommodated in the unit case 2*c*. The electroacoustic transducer 20 pressures together the elastic members 51 and 52. That is, the diaphragm holder 21 of the electroacoustic transducer 20 accommodated in the unit case 2*c* presses the elastic member 52 toward the flange 2*f* of the unit case 2*c*. As a result, the elastic member 51 is pressed toward the flange 2*f* by the elastic member 52. The electroacoustic transducer 20 accommodated in the unit case 2*c* is fixed inside the unit case 2*c* with the lock ring 20*r*.

When the electroacoustic transducer 20 is accommodated in the unit case 2*c*, then the elastic members 51 and 52 are pressed toward the flange 2*f* by the diaphragm holder 21 and toward the diaphragm holder 21 (diaphragm 22) by the flange 2*f*. In other words, the elastic members 51 and 52 are held between the unit case 2*c* and the electroacoustic transducer 20 with receiving internal stress such that the elastic members 51 and 52 press each other. The elastic members 51 and 52 are supported inside the unit case 2*c*.

<Condenser Microphone>

The condenser microphone according to the present invention (hereinafter referred to as "microphone") will now be described.

Figure 3:
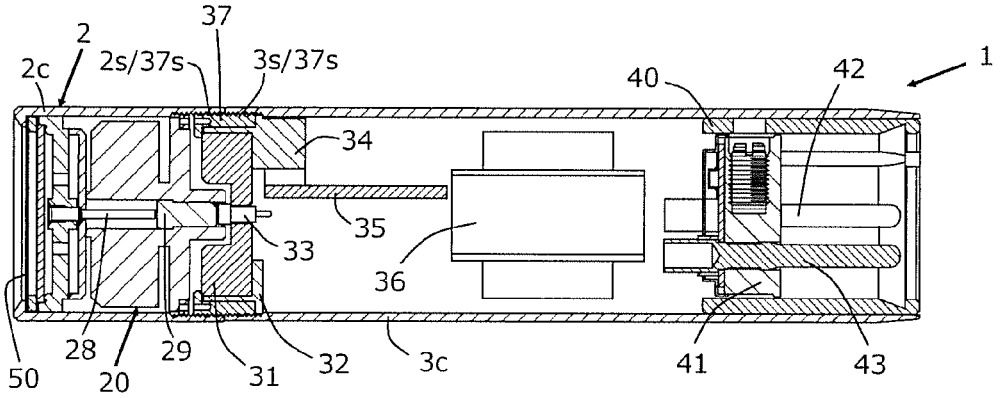
FIG. 3 is a cross-sectional side view of a condenser microphone according to the present invention.

FIG. 3 is a cross-sectional side view illustrating an embodiment of the microphone.

A microphone 1 includes the unit 2 described above, a circuit case 3*c*, a connector holder 31, a holder 32, a contact probe 33, a base fixture 34, an audio-signal output circuit board 35, an output transformer 36, a connecting member 37, a connector case 40, and an output connector.

The circuit case 3*c* is composed of metal. The circuit case 3*c* has a shape of a cylinder. The circuit case 3*c* includes an internal thread 3*s*. The internal thread 3*s* is disposed on the inner circumferential surface of the front side of the circuit case 3*c*.

The connector holder 31, the holder 32, the contact probe 33, the base fixture 34, the audio-signal output circuit board 35, the output transformer 36, and the connector case 40 are accommodated in the circuit case 3*c*.

The connector holder 31 is composed of an insulating material. The connector holder 31 is supported by the holder 32. The connector holder 31 is attached inside the front end of the circuit case 3*c* with the holder 32. The connector holder 31 has a hole. The penetrating direction of the hole is the thickness direction (the horizontal direction in FIG. 3) of the connector holder 31. The contact probe 33 is electrically connected to the contact pin 29 of the unit 2. The contact probe 33 is inserted into the hole in the connector holder 31.

The base fixture 34 supports the audio-signal output circuit board 35. The base fixture 34 is integrated with the holder 32. The audio-signal output circuit board 35 has a shape of a substantially rectangular plate. The audio-signal output circuit board 35 is supported by the base fixture 34. The audio-signal output circuit board 35 is fixed inside the circuit case 3*c* with the base fixture 34. A field effect transistor (FET) and a circuit, for example, are included in the audio-signal output circuit board 35. The FET constitutes an impedance converter of the electroacoustic transducer 20. The circuit is, for example, a circuit which converts a variation in the capacitance between the diaphragm 22 and the fixed electrode 24 to electrical signals and outputs the electrical signals. The gate of the FET is electrically connected to the fixed electrode 24 via the electrode extraction terminal 28, the contact pin 29, and the contact probe 33.

The output transformer 36 includes a secondary coil with a center tap. The output transformer 36 matches the output impedance of a hot signal with the output impedance of a cold signal from the audio-signal output circuit board 35.

The connecting member 37 connects the unit case 2*c* and the circuit case 3*c*. The connecting member 37 has a shape of a cylinder. The connecting member 37 includes an external thread 37*s*. The external thread 37*s* is disposed on the outer circumferential surface of the connecting member 37.

The unit case 2*c* is attached to the circuit case 3*c* via the connecting member 37. The external thread 37*s* of the connecting member 37 is fit together with the internal thread 2*s* of the unit case 2*c* and the internal thread 3*s* of the circuit case 3*c*. The electroacoustic transducer 20 and the acoustic resistor 50 are accommodated in the unit case 2*c*, as described above.

The connector case 40 is composed of metal, such as brass alloy. The connector case 40 has a shape of a cylinder. The output connector is accommodated in the connector case 40. The output connector, for example, includes a first pin for ground (not shown), a second pin 42 for hot signals, and a third pin 43 for cold signals, defined in JEITA Standard RC-5236 "Circular Connectors, Latch Lock Type for Audio Equipment." The first pin is electrically connected to the connector case 40 as a ground. The output connector includes a connector base 41. The connector base 41 is composed of an insulating material, such as polybutadiene terephthalate resin. The connector base 41 has a shape of a disc. The first pin, the second pin 42, and the third pin 43 are press-fit to the connector base 41. The first pin, the second pin 42, and the third pin 43 penetrate the connector base 41. The output connector is mounted inside the rear end of the circuit case 3*c* with the connector case 40. The connector case 40 also functions as a shield case of the output connector.

The electroacoustic transducer 20 outputs electrical signals in response to the vibration of the diaphragm 22 caused by acoustic waves from a sound source entering the unit case 2*c* through the acoustic-wave entering hole 2*h*. The microphone 1 outputs the electrical signals from the electroacoustic transducer 20 to an external unit via the audio-signal output circuit board 35, the output transformer 36, and the output connector inside the connector case 40.

The acoustic resistor 50 disposed between the acoustic-wave entering hole 2*h* and the diaphragm 22 is held between the unit case 2*c* and the electroacoustic transducer 20. Thus, the acoustic resistor 50 does not vibrate in response to acoustic waves from a sound source. As a result, a frequency response of the microphone 1 in a high frequency band becomes flat.

Figure 4:
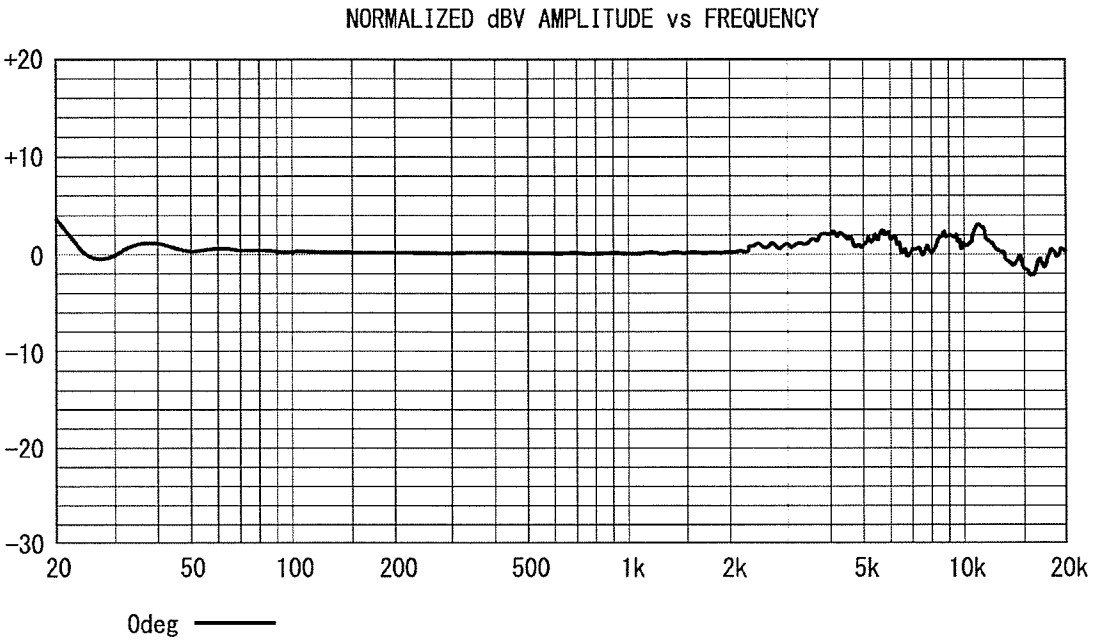
FIG. 4 is a graph illustrating the frequency response of the condenser microphone in FIG. 3.

FIG. 4 is a graph illustrating the frequency response of the microphone 1.

Figure 7:
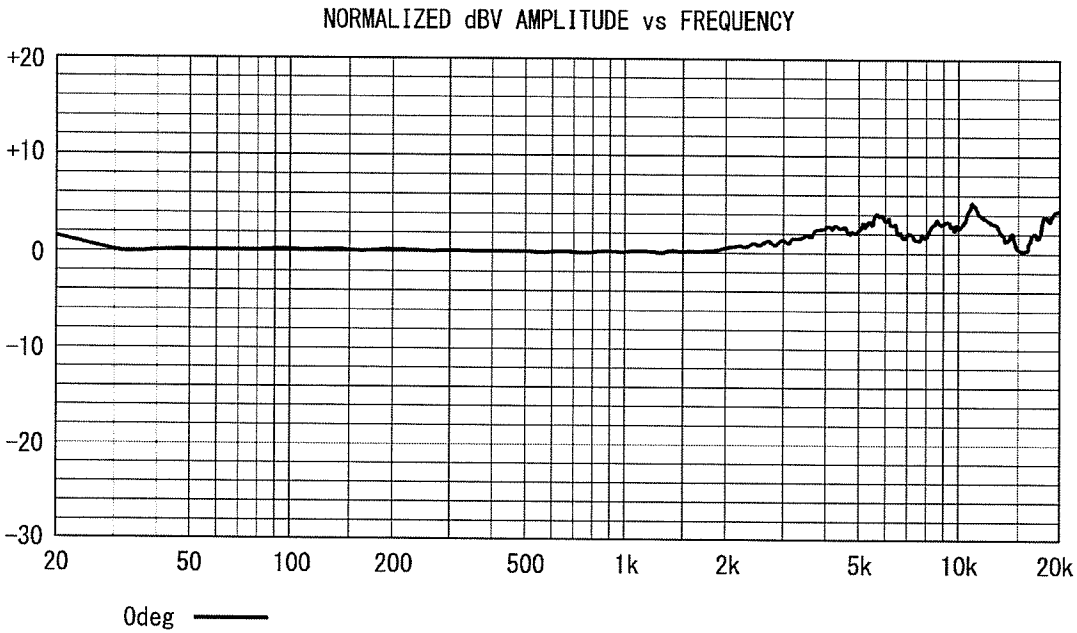
RELATED ART FIG. 7
FIG. 7 is a graph illustrating the frequency response of the conventional condenser microphone.
Figure 8:
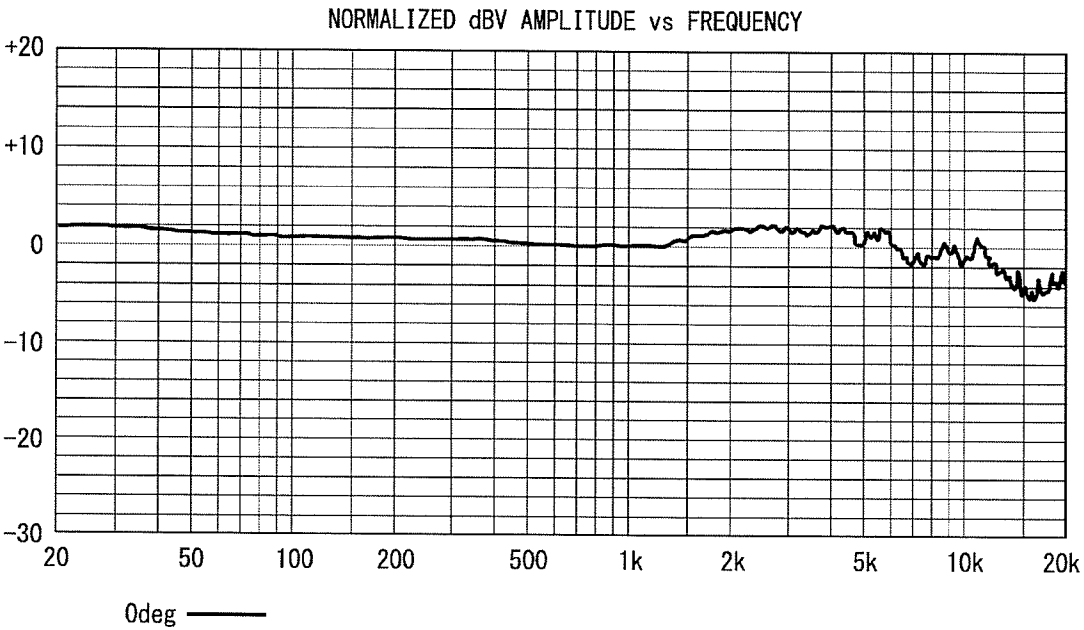
RELATED ART FIG. 8
FIG. 8 is a graph illustrating the frequency response of another conventional condenser microphone.

FIG. 4 indicates that the frequency response of the microphone 1 in a high frequency band is flat compared to the frequency response of the conventional microphone illustrated in FIGS. 7 and 8.

CONCLUSION

According to the embodiment described above, the acoustic resistor 50 held between the unit case 2*c* and the electroacoustic transducer 20 does not vibrate in response to acoustic waves from a sound source. Thus, the microphone 1 according to this embodiment can flatten the frequency response of the microphone 1 in a high frequency band.

The invention claimed is:

1. A condenser microphone unit comprising:

a unit case having an acoustic-wave entering hole;

a diaphragm accommodated in the unit case, wherein the diaphragm is configured to vibrate in response to acoustic waves from the acoustic-wave entering hole; and an acoustic resistor disposed between the acoustic-wave entering hole and the diaphragm, wherein the diaphragm constitutes an electroacoustic transducer, the acoustic resistor includes two elastic members in pressure contact with each other, at least one of the two elastic members is curved in a convex shape before contacting the other of the two elastic members by the pressure contact, a convex surface of the at least one of the two elastic members curved in the convex shape is in the pressure contact with the other of the two elastic members, and the two elastic members are supported inside the unit case with receiving internal stress from the unit case and the electroacoustic transducer such that the two elastic members press each other.

2. The condenser microphone unit according to claim 1, wherein the acoustic resistor is held between the unit case and the electroacoustic transducer.

3. The condenser microphone unit according to claim 2, wherein the electroacoustic transducer includes a diaphragm holder which stretches the diaphragm with predetermined tension, and the two elastic members are pressed toward the unit case by the diaphragm holder.

4. The condenser microphone unit according to claim 1, wherein the unit case has a shape of a hollow cylinder with a closed end, the acoustic-wave entering hole is disposed in a bottom face of the unit case, and the two elastic members are pressed toward the diaphragm by a flange disposed on the bottom face.

5. The condenser microphone unit according to claim 1, wherein the one of the two elastic members has a central portion curved in the convex shape before the pressure contact.

6. The condenser microphone unit according to claim 1, wherein each of the two elastic members is curved in the convex shape, and convex surfaces of the two elastic members are in pressure contact with each other.

7. A condenser microphone comprising:

a condenser microphone unit, wherein the condenser microphone unit is the condenser microphone unit according to claim 1.

8. A method of manufacturing a condenser microphone unit comprising:

a unit case having an acoustic-wave entering hole;

a diaphragm accommodated in the unit case, wherein the diaphragm is configured to vibrate in response to acoustic waves from the acoustic-wave entering hole; and an acoustic resistor disposed between the acoustic-wave entering hole and the diaphragm, wherein the diaphragm constitutes an electroacoustic transducer, the acoustic resistor includes two elastic members in pressure contact with each other, at least one of the two elastic members is curved in a convex shape before contacting the other of the two elastic members by the pressure contact, the two elastic members are supported inside the unit case with receiving internal stress from the unit case and the electroacoustic transducer such that the two elastic members press each other, the method comprising the steps of:

a) accommodating the two elastic members in the unit case; and b) pressuring the two elastic members together with accommodating the diaphragm in the unit case.

9. The method of manufacturing a condenser microphone unit according to claim 8, wherein the electroacoustic transducer includes a diaphragm holder which stretches the diaphragm, and step b) comprising the steps of b1) accommodating the diaphragm in the unit case; and b2) pressuring the two elastic members by the diaphragm holder, wherein step b1) is simultaneously carried out with step b2).

10. The method of manufacturing a condenser microphone unit according to claim 8, wherein the two elastic members are held between the unit case and the electroacoustic transducer and come into pressure contact with each other when the two elastic members are pressed toward the unit case by the diaphragm holder.

* * * * *